United States Patent [19]

Yoho, Sr.

[11] 4,403,481

[45] Sep. 13, 1983

[54] COMBINATION ROOF MOUNTING CURB AND PLENUM

[76] Inventor: Robert W. Yoho, Sr., 12900 Automobile Dr., Clearwater, Fla. 33520

[21] Appl. No.: 237,857

[22] Filed: Feb. 25, 1981

[51] Int. Cl.[3] ..... F25D 23/12

[52] U.S. Cl. ..... 62/259.1; 62/DIG. 16

[58] Field of Search ..... 62/259.1, 263, 324.1, 62/DIG. 16, 310; 98/31; 165/48

[56] References Cited

U.S. PATENT DOCUMENTS

| | | | |
|---|---|---|---|
| 2,066,013 | 12/1936 | Murphy et al. | 62/310 X |
| 3,766,750 | 10/1973 | Aoh et al. | 62/259.1 |
| 4,016,729 | 4/1977 | Cherry | 62/259.1 |
| 4,118,083 | 10/1978 | Lackey | 62/DIG. 16 |
| 4,167,210 | 9/1979 | Young | 62/DIG. 16 |

*Primary Examiner*—Lloyd L. King

*Attorney, Agent, or Firm*—Frijouf, Rust & Pyle

[57] ABSTRACT

A curb for a roof air conditioning package is enclosed on all sides and the bottom to form a plenum. The air conduits from and to the building are connected to the plenum rather than the unit. The plenum is reinforced by a wood collar around the top, which then serves as a second function of a roofing nailer strip. The curb is leveled by wedge supports.

4 Claims, 6 Drawing Figures

COMBINATION ROOF MOUNTING CURB AND PLENUM

BACKGROUND OF THE INVENTION

Home air conditioning systems generally divide the condenser and compressor functions because the home structure usually has a pitched roof. Further, the homeowner would not accept roof placement for asethetic reasons.

Commercial buildings, in contrast, usually have flat roofs, upon which an air conductor unit may be conveniently mounted. The commercial units include fresh air intake and recirculation intake provisions with both compressor and condenser functions in the same unit.

The unit is generally installed by building a frame, known in the trade as a "curb", to mount the unit above the roof line. The curb mounts the unit above water level on the roof.

The curb is placed around a roof opening and weather sealed by the roofer. Ducts are extended through the curb to the air conditioning unit for tempered air delivery and room air return. Comfort air conditioning had its first major use in motion picture theaters during the early 1920's. Motion picture theaters were among the first to adopt this new technology and by the late 1920's several hundred theaters throughout the country had been air conditioned. These were custom-designed, custom-manufactured, field-installed systems, which meant most of the assembly and erection of components was done on the job site.

The first self-contained room air conditioning systems began to appear toward the end of the 1920 decade. At that time the industry first attempted to package products that could be manufactured in mass production and factory tested prior to shipment to the ultimate user.

From that time on, rapid development took place in new and better refrigerants, precharged lines, and the refinement of heat pumps. The final major product innovation that occurred during the late 1950's and early 1960's and still accounts for the most dramatic growth rate of all packaged year-round conditioners is the rooftop conbination of heating and cooling units. This development started with small two to five ton systems being installed on the rooftops of low-rise commercial structures as well as some residential applications. At the present time capacities range upwards of 100 tons of cooling. Both gas and electricity are available for heating.

However, perfection has not been achieved in all respects. The roof installations currently available generally require considerable skilled labor on-site custom fitting. Prepackaged units, although self-contained, are necessarily fitted with some means of ducting the conditioned air through the roof into the structure, and receiving back room air for reconditioning. One of the common means of accomplishing this type of installation is to mount the prepackaged unit on elevated stilts of structural iron to keep the unit above the flood level on the roof structure. The duct work is then run through openings in the roof which are sealed by various roofing techniques, some of which are successful.

From this early beginning, there has been developed the concept of using a curb structure, which is essentially a dyked opening. The dyke prevents the entrance of water into the building and simultaneously supports the conditioning unit above the flood level on the roof.

The roof curb varies for different manufacturers but essentially is constructed as shown in FIGS. 5 and 6 of the drawings. FIGS. 5 and 6 are supplied in order to enable a clear understanding of the contrast of this invention to the prior art and the purpose for the contrast.

In FIG. 6, a roof supporting beam 110 of the building supports conventional roof deck 114. It is common practice to use insulation 115 directly over metal roof decking. Then, the roofing material, such as felt and built-up roofing, is added to waterproof the roof.

The conventional structure employs a rigid, galvanized steel base 116 which is, in effect, a four-sided dyke attached to the roof joist prior to the roof installation. Rigid foam insulation 117 is conventionally placed on the surface of the base dyke in order to prevent moisture condensation. A cant strip 118 is used to form a fillet for the roofing material in order to prevent cracking of the material in a sharp corner.

The prior art practice is illustrated in the provision of a wood nailing strip 119 in FIG. 6. The strip 119 is positioned on top of the side wall of base 116 and therefore requires, in this type of installation, an onsite skilled workman. Furthermore, the placement of the nailing strip requires the base side wall to support the nailing strip. The present invention reverses that function, as will be explained in more detail.

The roofing material is extended up over the insulation 117 and nailed to the strip 119 for a solid anchor. Outer flashing 120 is then extended down over the nailing strip and roofing material to shield the joint ending of the roofing against blowing water leaks.

In this prior conventional structure, a further upright annular insulation wall 121 is secured to the top of the base 116. Then, the unit 122, containing the factory assembled air conditioning equipment, is placed on top of the curb. It is common practice to provide such unit with a base channel 123 and to use an indexing pin 124 to locate the unit by means of an indexing opening in the base channel 123.

The unit 122 is provided with a soft, flexible insulation channel 124 which fits down upon the annular wall 121 and forms an air lock seal. It is generally not necessary to bolt the unit 122 upon the curb but rather to let it sit over the guide pin and partially supported by compression of the flexible insulation material.

After the unit is seated in place upon the structure thus described, duct work must be secured into suitable openings in the bottom of the factory supplied unit. FIG. 5 of the drawings represents an oversimplified cross-section of the components of a unit 122. A return air duct is extended up through the opening outlined by the curb base 116 and attached to the unit. Return air is directed over filters 126 and through the cooling coil 125 by a circulation fan 128. The air is then forced through the heat exchanger and out through a supply duct to the conditioned space.

FIG. 5 emphasizes the prior art method for the connection of duct work 27 to the unit to receive and distribute the conditioned air. In most installations only a single outlet is provided and distribution must be done by custom metal work within the building itself. By contrast, the present invention employs the curb as a distribution chamber or plenum as well as for support of the unit, as will be further explained.

Such prior construction requires considerable skilled installation labor in that the fitting of the ducts to the units is custom work requiring skilled personnel.

Inherent in custom installation is delay. The logistics of tradesmen supply is a known frustration to speedy construction.

Further, weather sealing has been known to present severe problems. The curb is usually metal. The roofing material sticks well to metal when fresh, but soon loses elasticity and then cracks develop to allow water leaks.

Therefore it is an object of this invention to provide an apparatus which overcomes the aforementioned inadequacies of the prior art devices and provides an improvement which is a significant contribution to the advancement of the air conditioning installation art.

It is another object of this invention to provide a factory built curb requiring little on-site skilled labor.

A further object is to enable a positive attachment of roofing to the curb to prevent water leaks.

It is also a primary object to enable better plenum distribution of the tempered air by means of a chamber area separate from the air conditioning unit.

A further object is to provide for return air through the curb chamber in order to avoid on-site establishment of this function.

Yet another object is to provide a fully factory built curb but tailored to specific installation requirements.

The foregoing has outlined some of the more pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description describing the preferred embodiment in addition to the scope of the invention defined by the claims taken in conjunction with the accompanying drawings.

SUMMARY OF THE INVENTION

A prefabricated unit curb acts as a plenum as well as a support. The plenum function accepts the total output of the air conditioning unit, which usually is cooled air, but may be the tempered air of a heat pump, either hot or cold, or of a fuel fired furnace.

The plenum function is then to deliver tempered air through damper controlled outlets where needed. Thus the curb plenum serves as a distributor to supply air to the ducts in proportion to their need. One feature of this invention is a nailer strip cuff which serves the dual function of stiffening the curb and providing a nailing anchor for roofing.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION

Figure 1:
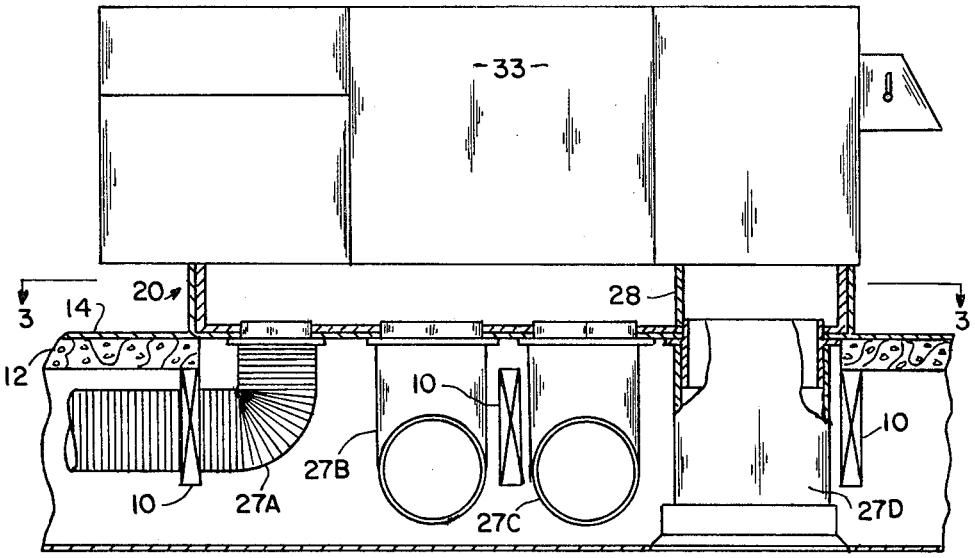
FIG. 1 is a vertical section through a roof portion of a building and the curb of this invention, with an air conditioning unit resting thereon, not in section.
Figure 2:
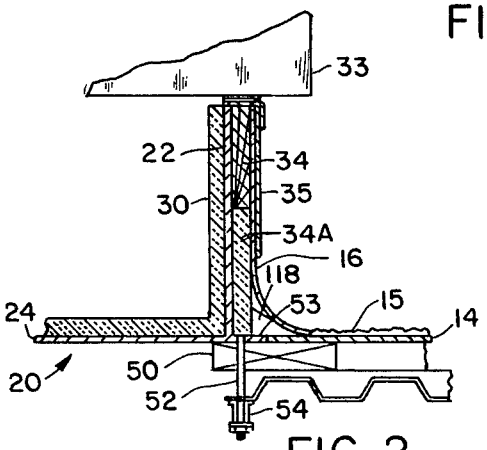
FIG. 2 is an enlarged detail of the corner construction of the curb of this invention.

FIG. 1 of the drawings is an elevation of an actual installation as taken from blueprints used for mounting instructions for workmen. The drawing is modified only in the elimination of detail not necessary to an understanding of the invention. The waterproof roofing is not illustrated in FIG. 1 but is shown in FIG. 2. FIG. 1 shows a series of bar joists 10 upon which conventional decking 12 is mounted to support the roof sheeting 14. The roof sheeting 14 is made waterproof, seen only in FIG. 2, by conventional roofing application 15. Generally this is referred to as a "built-up" roof and embodies essentially a bituminous material and stone together with roof felt 16. A cant strip 118 supports the roofing at the base.

The curb of this invention is designated generally by the reference character 20 and comprises an open top box defined by a perimeter wall 22 and a bottom wall 24 of galvanized steel or other moisture resistant structural material. The bottom wall is equipped with duct connectors 26 of various sizes to which ducts 27A, 27B, 27C and 27D are attached.

Although the duct connectors may be custom spaced according to the particular installation location, it is within the scope of this invention to place the connectors at spaced intervals, and even to provide a plurality of openings with removable caps in order that the duct connectors may be placed at the convenience of the installer.

Figure 4:
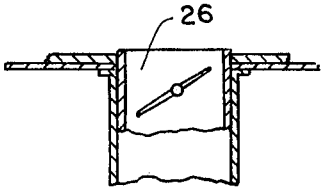
FIG. 4 is a detail of a connector shown along line 4—4 of FIG. 3.
Figure 3:
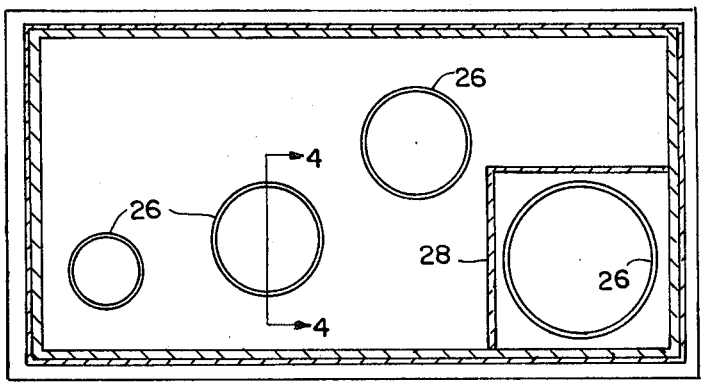
FIG. 3 is a top plan view of the curb of this invention taken along line 3—3 of FIG. 1.
Figure 5:
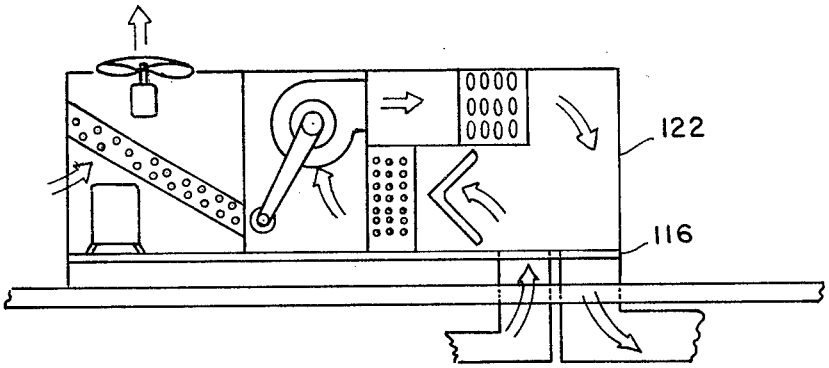
FIG. 5 is a structure detail of the prior art practice.
Figure 6:
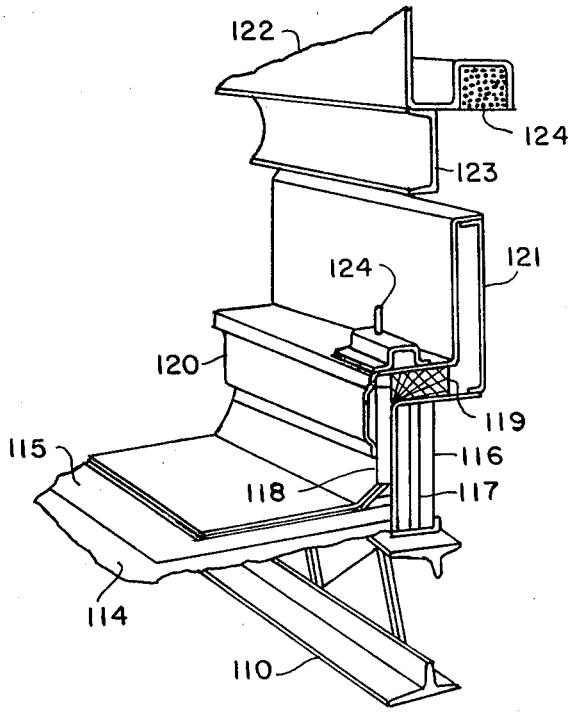
FIG. 6 is a schematic of a roof conditioner package mounted on a conventional support.

In FIG. 4 the duct connectors are illustrated as short sleeves of galvanized metal to which the flexible duct work is secured by means of tape, attachment screws, or compression bands. In view of the conventional nature of such fastening devices, only a slip fit is shown in FIG. 4.

Whether only the specified connectors 26 are provided, or whether a random supply of capped openings is provided, the air distribution from the interior of the curb plenum is preferably controlled by means of conventional dampers. A butterfly damper is illustrated in FIG. 4, although any conventional flow control may be employed. Thus, the plenum will accept any number of ducts, up to the complete area capacity of the bottom of the curb and in any size or combination of sizes which will enable the adequate distribution and recovery of air within the building to be served.

One feature of the present invention is that the curb is equipped with an isolation partition 28 within the perimeter walls. Wall 28 extends to the top level of the curb for connection to the recirculation intake of the air conditioning unit and thereby permits the return air duct 27D to be connected to its connector 26. The air flow is directed through the plenum of the curb and enters directly into the intake of the air conditioning unit placed directly on top of the curb. This feature is in keeping with the prefabrication concept of the present invention. It is desirable that walls 28 be of fully insulated construction in order to avoid a heat exchange in the curb which, although slight, is counter-productive to the intent of distribution of the instrument controlled conditioning unit.

The object of this invention is to enable a rapid installation of an air conditioning unit into a system on a building with a minimum amount of on-site skilled labor. In the drawing, a commercial air conditioning unit 33 is illustrated. Generally, the system will comprise only a refrigeration and fuel system although it is entirely within the scope of the present invention to service a heat pump type of air tempering unit.

Whether an air conditioning unit is cooling or heating, the unit is located on the exterior of the building and the air circulating fan within the unit drives air over a heat exchanger and into the plenum system to duct members which accept delivery of the tempered air to designated outlets within the building. This invention provides for a unique system wherein the plenum concept is provided by the curb.

The curb of the prior art is generally provided only to elevate the air conditioning system up from the roof level in order to protect it against flood water during heavy rain, but the present invention provides many more features. Basically, a bulk plenum is provided which enables the air conditioning unit to simply dump all of the conditioned air into the plenum chamber and then permit the distribution and proportioning of the conditioned air by means of the dampers, placed in the outlets of the duct connectors 26. Adjustment of these dampers can then take place to proportion the distribution of air. This materially reduces the on-site labor by skilled metal workers that is needed in construction, and speeds the work.

Another feature of this invention is the provision of a wooden nailer strip 34 around the cuff of the curb to both strengthen the curb and provide an anchor point for the roof felt 16. The space below is filled with an insulation plank 34A. The prior art nailing strip has previously been explained. This invention provides a preconstructed unit which provides for nailing and also for strengthening of the unit, a feature not provided by the prior unit. The felt is run up along the side of the curb and tacked to the wooden strip in order to anchor the felt and provide a waterproof boot. The felt is swabbed with tar compound to reinforce and seal any cracks or cuts.

Additionally flashing 35 is used to cover the upper portion of the felt and provide additional sealing. Finally the interior of the curb is insulated by insulating material 30 to prevent condensation.

Although flat roof construction appears to be perfectly level, and occasionally has spots which collect rainwater, it is normally the case that the roof is slightly tapered for rainwater to runoff in one direction. Accordingly, this invention employs leveling strips 50 which may be of any suitable material, but preferably are metal wedges substantially equal to the length and width of the plenum unit. The wedge is approximate the normal slope of the building whereby the top surface of the wedge 50 is substantially level.

The curb is then placed in position on top of the leveling strip and a bolt 52 is extended through a lip 53 to an anchor point in the building structure. It is preferable that a resilient lock nut 54 be employed to prevent overtightening and to absorb shock.

The nailing strip 34 composes the upper portion of the exterior wall of the curb and is secured as a cuff around the upper perimeter of the curb. Such location of the nailer strip, rather than depending upon the wall of the curb for support, actually provides an additional measure of strength at the point where the load is placed upon the top of the curb. This nailer strip then provides the double purpose of enforcing the strength of the curb and providing a nailable location to attach the roofing material.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described:

What is claimed is:

1. A curb to support an air conditioner on the roof of a building and distribute conditioned air, comprising in combination:

four upstanding exterior walls;

the ends of said exterior walls being connected together in the form of a rectangular box;

the bottom edges of said exterior walls being connected together with sheet material whereby an open-top rectangular box is formed;

an upstanding interior wall;

the ends of said interior wall being connected to the insides of different exterior walls whereby a plenum is formed; and the bottom of said plenum being of sufficient size to accept a plurality of air conditioning supply ducts connected thereto at any desired location therewithin.

2. An apparatus as set forth in claim 1, wherein said plenum accepts chilled air from the air conditioner; and said plenum distributes chilled air to said air conditioning supply ducts connected thereto.

3. An apparatus as set forth in claim 2, wherein the inside surfaces of the walls forming the plenum are thermally insulated.

4. An apparatus as set forth in claim 1, wherein a nailer strip is attached to the periphery of said exterior walls:

said nailer strip being composed of a material that will accept nails;

said nailer strip being attached to the top edge of said exterior walls; and said nailer strip enabling roofing felts to be nailed thereto whereby a weatherproof seal is formed between the curb and the remainder of the roof.

* * * * *